United States Patent [19]

Hewins

[11] Patent Number: 4,554,806

[45] Date of Patent: Nov. 26, 1985

[54] MOTOR DRIVEN MINI-WRINGER

[76] Inventor: Doris J. Hewins, 835 Oak Hills Dr., Monument, Colo. 80132

[21] Appl. No.: 580,738

[22] Filed: Feb. 16, 1984

[51] Int. Cl.[4] ..... D06F 45/02; D06F 45/24; D06F 45/26

[52] U.S. Cl. ..... 68/257; 68/264; 68/270; 68/271; 100/53; 100/121; 192/130

[58] Field of Search ..... 68/22 A, 238, 245, 253 B, 68/253 C, 257, 259, 264, 269 C, 270, 271; 100/53, 121, 134, 135; 15/262; 192/130

[56] References Cited

U.S. PATENT DOCUMENTS

| | | | |
|---|---|---|---|
| Re. 9,158 | 4/1880 | Roth | 68/271 |
| 586,239 | 7/1897 | Knowles | 68/245 |
| 999,647 | 8/1911 | Higgins | 68/245 X |
| 1,220,620 | 3/1917 | Freeman | 192/130 X |
| 1,315,613 | 9/1919 | Strauser | 68/270 |
| 1,913,314 | 6/1933 | Engel | 68/271 X |
| 1,970,957 | 8/1934 | Erickson | 192/130 X |
| 1,993,091 | 3/1935 | Etten . | |
| 2,056,252 | 10/1936 | Castino | 68/253 C |
| 2,308,445 | 1/1943 | Etten | 68/253 C X |
| 2,493,916 | 1/1950 | Gibson | 68/271 X |
| 2,603,328 | 7/1952 | Jordan | 192/130 X |
| 2,677,951 | 5/1954 | Haines et al. . | |
| 2,778,213 | 1/1957 | Naxon . | |
| 3,987,513 | 10/1976 | Gonzales . | |
| 4,085,303 | 4/1978 | McIntyre et al. | 192/130 X |
| 4,295,421 | 10/1981 | Abendroth et al. | 192/130 X |

FOREIGN PATENT DOCUMENTS

| | | | |
|---|---|---|---|
| 519832 | 4/1940 | United Kingdom | 68/271 |

*Primary Examiner*—Philip R. Coe
*Attorney, Agent, or Firm*—Michael O. Sturm

[57] ABSTRACT

A motor driven wringer unit for use in combination with a counter and sink of the type commonly found in a household kitchen. A motor driven wringer has a frame with a pair of rollers rotatably attached thereto and a motor for rotating one of the rollers whereby a cloth or sponge will pass between the rollers and squeeze the liquid out of such wet cloth or sponge to achieve a predesired dampness in such cloth or sponge. A liquid catching arrangement is provided for catching liquid extracted from the cloth or sponge and a spout is provided for directing such liquid back into a sink or the like. A base is provided for the aforementioned apparatus whereby the motor driven wringer unit can be placed on a counter adjacent to a sink wherein the spout means will direct the liquid extracted from the cloth or sponge into the sink. A safety mechanism is also provided on the wringer apparatus for automatically turning off the rollers when the user's hand is in danger of being caught between the rollers.

1 Claim, 6 Drawing Figures

MOTOR DRIVEN MINI-WRINGER

TECHNICAL FIELD

The present invention relates to a wringer apparatus for removing liquids from a cloth, sponge or the like and more particularly to a motorized mini-wringer for use in combination with a sink.

BACKGROUND ART

A universal problem in homes, restaurants, business establishments or other places where cleaning is done with a wet cloth, sponge or the like, is the one of maintaining the sponge or cloth at the proper moisture content or dampness for efficient clean-up, especially when such sponge or cloth often requires cleaning by rinsing it frequently. Typically, the cloth or sponge is rinsed in water, a solution of water or soap or some other cleaning solution, and then is squeezed by hand until it is at the desired degree of dampness for effective use. Once the sponge or cloth is dirty, then the procedure is repeated whereby the sponge or cloth is completely soaked in liquid and then needs to be squeezed again to the desired degree of dampness. This procedure is typically done every few minutes in the course of the cleaning process and this process goes on in nearly every household every day of the year.

The process of repeatedly squeezing a rag or sponge to attain the desired degree of dampness is not only tedious, but can be detrimental to the skin, bones, and joints of the hands. In addition, any cuts, bruises, or arthritic problems could be aggravated. Consequently, there is a real need of a better solution for removing liquids from a cloth or sponge to obtain, more efficiently, the desired degree of dampness.

Prior to the advent of the automatic washing machine which utilizes centrifical force to spin the water from clothes which have been washed, many washing machines had a wringer apparatus attached thereto whereby the wet clothes could be directed through such wringer with the water from the wet clothes being directed back to the washing machine tub. For example, U.S. Pat. Nos. 1,993,091 to Etten, 2,677,951 to Haines et al, 2,778,213 to Naxon, and 3,987,513 to Gonzales show generally the state of the art of such wringer mechanisms of the aforementioned type. This prior art is not, however, practical for use in solving the problem of drying a cleaning cloth or sponge to a desired dampness and therefore there is a need for a wringer mechanism which is practical for this use to solve the aforementioned problem.

DISCLOSURE OF THE INVENTION

The present invention relates to a motor driven wringer unit for use in combination with a counter and sink of the type commonly found in a household kitchen. A motor driven wringer has a frame with a pair of rollers rotatably attached thereto and a motor for rotating one of the rollers whereby a cloth or sponge will pass between the rollers and squeeze the liquid out of such wet cloth or sponge to achieve a predesired dampness in such cloth or sponge. A liquid catching arrangment is provided for catching liquid extracted from the cloth or sponge and a spout is provided for directing such liquid back into a sink or the like. A base is provided for the aforementioned apparatus whereby the motor driven wringer unit can be placed on a counter adjacent to a sink wherein the spout means will direct the liquid extracted from the cloth or sponge into the sink. A safety mechanism is also provided on the wringer apparatus for automatically turning off the rollers when the user's hand is in danger of being caught between the rollers.

An object of the present invention is to provide an apparatus for semi-automatically removing water from a cloth or sponge and achieving a desired dampness therein.

Another object of the present invention is to provide a motorized wringer unit which is compact and suitable for setting on a counter adjacent to a sink or drain and for directing liquids extracted from a cloth or sponge into such sink.

A further object of the invention is to provide a small motorized wringer of the aforementioned type which is safe to use.

Other objects, advantages, and novel features of the present invention will become apparent from the following detailed description of the invention when considered in conjunction with the accompanying drawings.

BEST MODE FOR CARRYING OUT THE INVENTION

Figure 1:
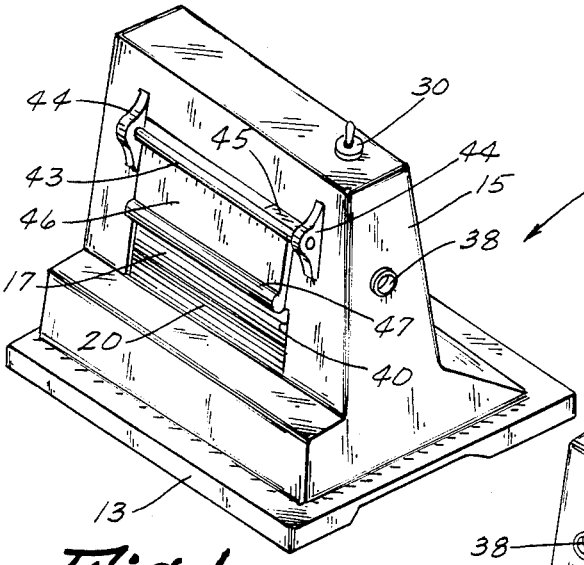
FIG. 1 is a perspective view of a preferred embodiment of the present invention showing an entrance opening for insertion of a wet cloth or sponge.
Figure 2:
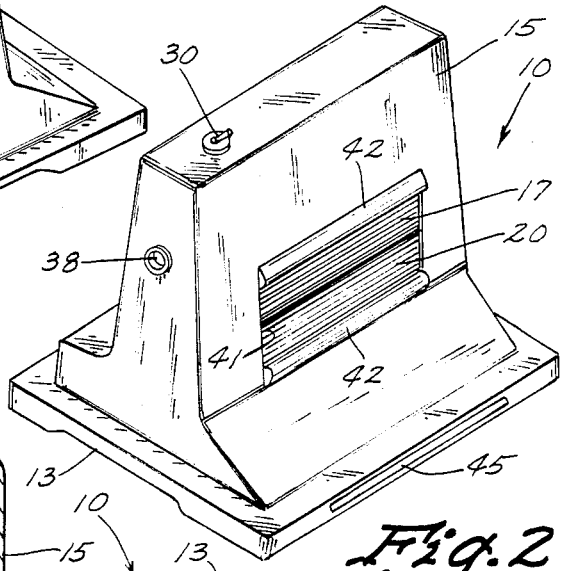
FIG. 2 is a perspective view of the present invention showing the opening through which a sponge or cloth will exit the housing.
Figure 3:
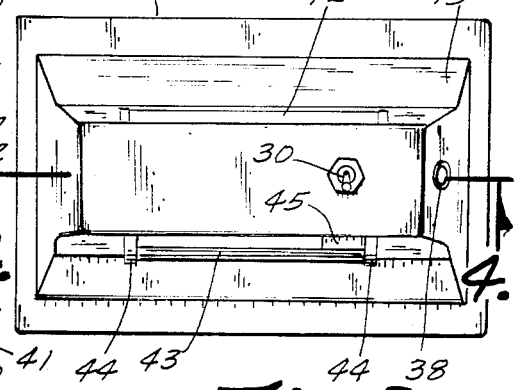
FIG. 3 is a top view of the preferred embodiment of the invention shown in FIGS. 1 and 2.
Figure 5:
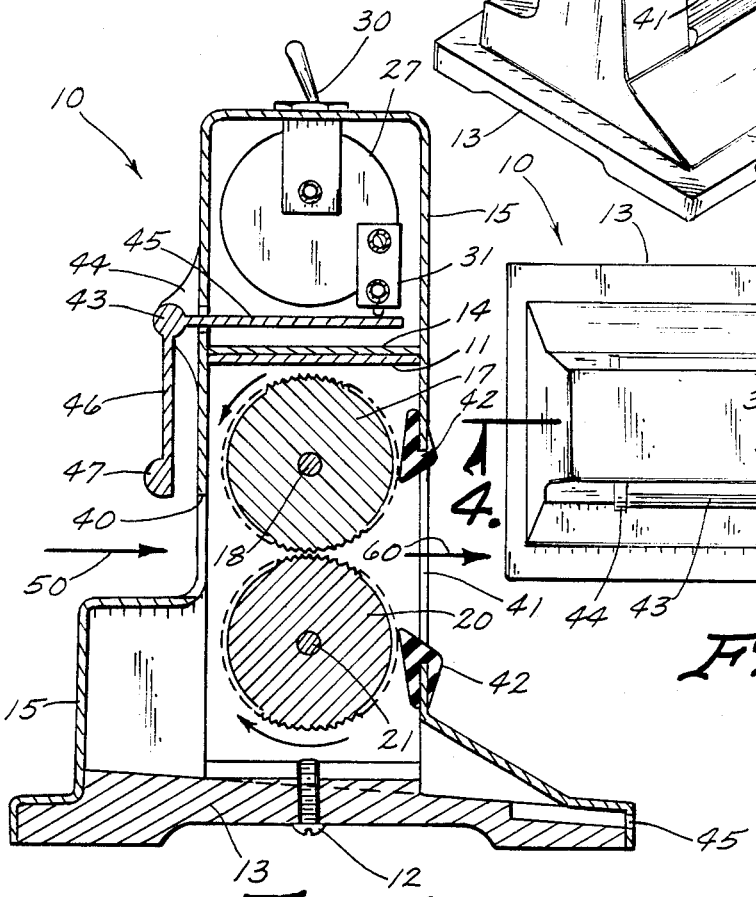
FIG. 5 is a cross-sectional view taken along line 5—5 of FIG. 4.
Figure 4:
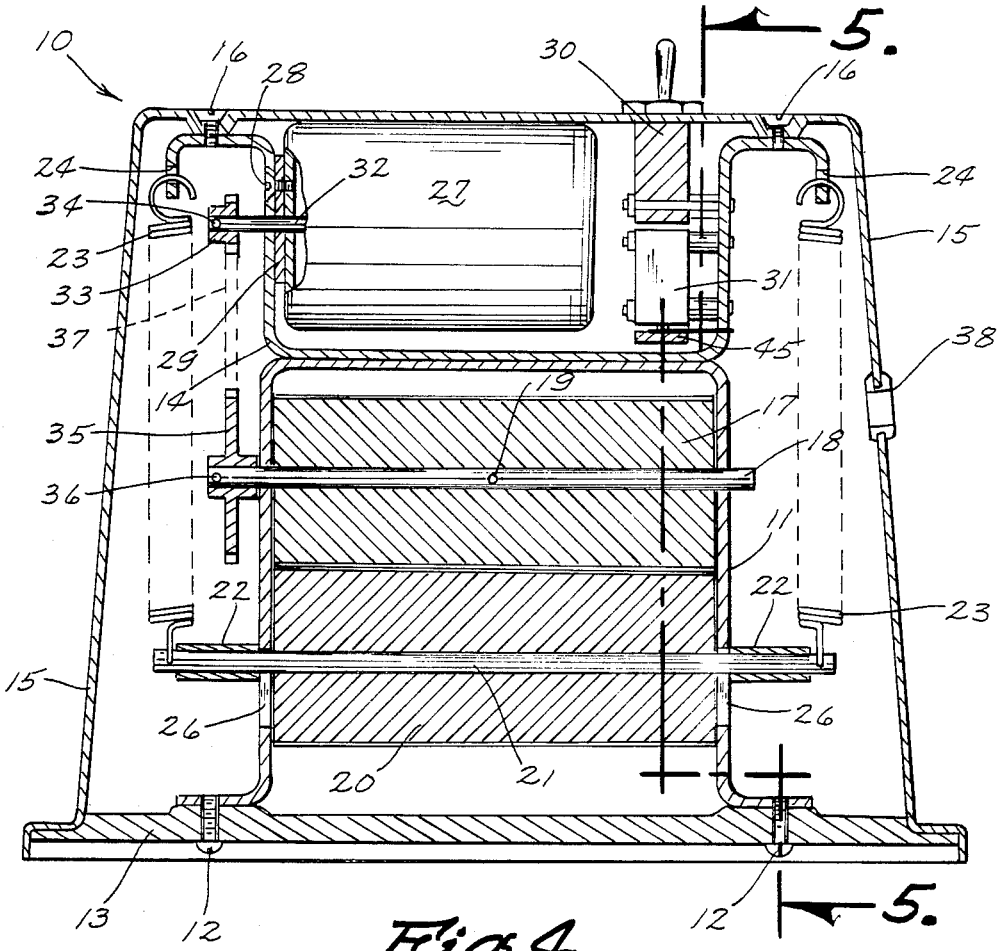
FIG. 4 is a cross-sectional view taken along line 4—4 of FIG. 3.

Referring now to the drawings wherein like reference numerals designate identical or corresponding parts throughout the several views, FIG. 1 shows a motorized wringer (10) constructed in accordance with the present invention. Referring to FIGS. 4 and 5, it is noted that a lower frame (11) is attached by fasteners (12) to a base member (13) and an upper motor frame (14) is attached to an outer housing (15) by means of fasteners (16).

A first roller (17) is rotatably attached to the frame (11) by means of an axle (18) secured for rotation with the roller (17) by means of a pin (19) which locks axle (18) and roller (17) together. A second roller (20) is operably rotatably attached within the frame (11) by being rotatably mounted around a shaft (21). The shaft (21) has spacers (22) disposed on the end thereof to maintain proper alignment of the shaft (21). Tension springs (23) are connected to each end of the shaft (21) and also through an opening (24) in the tip of the motor frame (14 . The tension springs (23) bias the lower roller (20) upwardly against the roller (17), and this movement is permitted by slots (26) disposed within the frame (11) to permit the shaft (21) to move upwardly or downwardly within the slots (26) as will be readily appreciated from viewing FIG. 4.

An electric motor (27) is rigidly mounted within the upper frame (14) by means of fasteners (28) which extend through the motor housing and through a resilient mounting pad (29) for cutting down on transmission of vibrations from the motor frame (27) to the frame (14).

Figure 6:
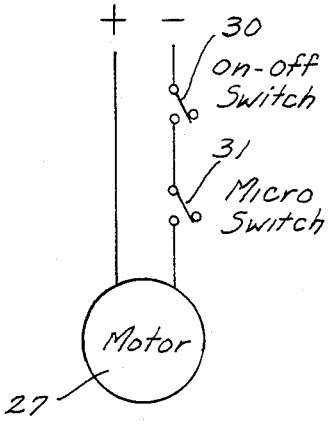
FIG. 6 is a schematic view of the electrical circuit of the present invention.

The electrical circuit for the motor (27) is shown schematically in FIG. 6 and includes an on/off switch (30) for manually turning the motor (27) on and off and a normally closed micro-switch (31).

The output shaft (32) on the motor (27) has a small sprocket (33) rigidly attached thereto by means of a pin (34); and, similarly, a larger sprocket (35) is rigidly attached to the roller shaft (18) by means of a pin (36). The roller chain (37) is disposed around the sprocket (33) of the motor and sprocket (35) of the roller whereby rotation of the motor shaft (32) will transmit rotary motion to the roller (17) as will be readily appreciated from viewing these elements in FIG. 4. It is also noted that a grommet (38) is provided on the outer housing (15) for permitting an electrical cord (not shown) to extend from an electrical outlet, through the housing (15), to the switches (30) which are ultimately wired to the motor (27) as will be clearly understood without further explanation to those skilled in the art by viewing the schematic diagram of FIG. 6.

Referring now to FIG. 5, it is noted that an inlet opening (40) is provided on one side of the housing (15) and an outlet opening (41) is provided on the other side of the housing (15). Rubber or plastic moldings (42) are disposed around the upper and lower edges of the opening (41) for keeping water within the housing (15) and for directing the cloths or sponges going therethrough towards the outlet opening and preventing such sponges or cloths from becoming stuck between the housing (15) and the rollers.

A safety device, including an L-shaped member (43), is pivotally mounted at the ends thereof to projections (44), which are, in turn, connected to the housing (15). The L-shaped member (43) has an inwardly directed leg (45) and a downwardly directed leg (46) with a projection (47) on the lower end thereof.

In operation, when it is desired to process a wet cloth or sponge to achieve a desired dampness by removing liquid therefrom, the on/off switch (30) is moved to the on position and, because the micro-switch (31) is in a normally closed position, the motor (27) will be turned on, thereby rotating the outlet shaft (32) and the sprocket (33), which will result in a turning of the roller (17) in the direction shown in FIG. 5 because of the movement of the chain (37) around the sprockets (33) and (35). This rotation of upper roller (17) will also result in rotation of the lower roller (20) in the direction shown in FIG. 5 because the roller (20) is biased upwardly against the roller (17). Consequently, when a cloth is inserted manually through the entrance opening (40), for example in the place shown by the arrow (50) in FIG. 5, then the rollers (17) and (20), having serrated outer surfaces thereon, will grasp the cloth or sponge and pull it through and between the rollers (17) and (20) and cause it to move to the position of the arrow (60) in FIG. 5. When this happens, the liquid within the sponge or cloth will be forced out of such sponge or cloth, and this liquid will run down onto the top of the base member (13) and will flow out through an opening (45) on the rear side of the housing (15). Consequently, it is necessary that the opening (45) be disposed over a sink or place for drainage. Accordingly, the apparatus (10) should be placed on a counter top adjacent to a sink whereby the opening (45) extends over into the sink.

If it should happen that a user gets his or her hand too close to the rollers (17) and (20) such that there is a danger of getting the user's hand caught between the rollers (17) and (20), then the user's hand will also strike the enlarged portion (47) of the safety bar (43) and this abutment of the user's hand against the projection (47) will pivot the safety bar (43) such that the leg (45) will move upwardly and push against the micro-switch (31), thereby opening the circuit and turning off the motor (27). Because the lower roller (20) pivots freely on the shaft (21) and is allowed to be pushed downwardly against the force of tension springs (23), the fingers can readily be removed from between the rollers. Once pressure is released from the member (47), then the micro-switch moves again to its normally closed position and the apparatus (10) is ready for use again.

Accordingly, it will be appreciated that the disclosed embodiment does indeed accomplish the objects set forth above. Obviously, many modifications and variations of the present invention are possible in light of the above teachings. It is therefore to be understood that, within the scope of the appended claims, the invention may be practiced otherwise than as specifically described.

I claim:

1. A motor driven wringer unit for use in combination with a kitchen counter and sink or the like comprising:

a frame;

a first roller rotatably attached to said frame;

a second roller operably rotatably attached to said frame;

means attached to said frame and to said second roller for biasing said roller towards and against said first roller;

said first and second rollers having serrated surfaces on the exterior thereof;

motor means operably connected to said first roller for selectively rotating said first roller, whereby rotation of said first roller will squeeze liquid out of a wet cloth or the like disposed between said rollers;

liquid catching means attached to said frame below said first and second rollers for catching liquids which have been forced out of a wet cloth or the like;

spout means connected to said liquid catching means for directing the flow of liquids from said liquid catching means into a sink or the like;

a housing attached to said frame, said housing including an inlet opening on one side thereof adjacent to the place where the first and second rollers touch each other; and an exit opening on the other side of the housing adjacent to the place where the first and second rollers touch each other whereby a wet cloth or the like may be placed in the inlet opening, and will be automatically squeezed through and between the rollers and out through the exit opening of the housing, said housing enclosing said first and second rollers, said biasing means and said motor means;

base means connected to said frame for permitting said wringer unit to be set on a counter adjacent to a sink wherein the spout means will direct liquids into the sink, said base means being rigidly connected to the frame and rigidly connected to the housing, said spout means being formed in the top of said base means and extending to an outlet opening in the housing whereby liquids flowing from said spout means will flow through said outlet opening in the housing;

safety means having an abutment portion thereof disposed towards the top of and adjacent to said inlet opening for turning off said motor means and thereby the rotation of said rollers when said safety means is pushed toward said rollers whereby if a user's hand is in danger of becoming caught between said rollers, said safety means will automatically be actuated to turn off the motor and permit the user's hand to be retracted, said safety means comprising a normally closed micro-switch having an actuator thereon which opens the circuit to said motor means when said actuator is depressed, said safety means further comprising an L-shaped member pivotally attached to said housing and having one leg thereof adjacent to the micro-switch actuator whereby when said abutment portion thereof is pushed toward said rollers, said one leg of the L-shaped portion depresses said micro-switch actuator;

on/off switch means connected in the circuit to control said motor means and attached to said housing for selectively turning the motor means on or off; and means disposed on housing adjacent to the bottom part of said exit opening having a downwardly sloping surface thereon for guiding a cloth or sponge out of said exit opening to prevent it from catching on the housing surface which forms said exit opening.

* * * * *